US009303480B2

(12) United States Patent
Williams

(10) Patent No.: US 9,303,480 B2
(45) Date of Patent: Apr. 5, 2016

(54) INNER DRILLING RISER TIE-BACK CONNECTOR FOR SUBSEA WELLHEADS

(71) Applicant: Dril-Quip, Inc., Houston, TX (US)

(72) Inventor: Gregory Dale Williams, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 154 days.

(21) Appl. No.: 14/137,124

(22) Filed: Dec. 20, 2013

(65) Prior Publication Data

US 2015/0176358 A1 Jun. 25, 2015

(51) Int. Cl.
*E21B 33/038* (2006.01)

(52) U.S. Cl.
CPC ..... *E21B 33/038* (2013.01)

(58) Field of Classification Search
CPC ..... E21B 33/038
USPC ..... 166/345, 360, 367
See application file for complete search history.

(56) References Cited

U.S. PATENT DOCUMENTS 4,681,166 A * 7/1987 Cuiper ..... 166/345
5,259,459 A * 11/1993 Valka ..... E21B 33/038 166/217
5,368,335 A * 11/1994 Dinnes ..... E21B 33/043 166/348
5,566,761 A * 10/1996 Pallini et al. ..... 166/345
5,671,812 A * 9/1997 Bridges ..... 166/348
5,775,427 A * 7/1998 Skeels et al. ..... 166/344
5,944,111 A * 8/1999 Bridges ..... 166/348
6,328,108 B1 * 12/2001 Vanderford et al. ..... 166/348
6,516,887 B2 * 2/2003 Nguyen et al. ..... 166/348
6,550,537 B1 * 4/2003 Alvarez et al. ..... 166/348
7,735,562 B2 * 6/2010 Bennett et al. ..... 166/345
7,896,081 B2 * 3/2011 Pallini et al. ..... 166/345
2011/0155382 A1 * 6/2011 Pallini et al. ..... 166/345
2012/0145405 A1 * 6/2012 Vanderford et al. ..... 166/341
2012/0211236 A1 * 8/2012 Braithwaite ..... 166/348

FOREIGN PATENT DOCUMENTS

EP 109541 A1 * 5/1984 ..... E21B 33/038

* cited by examiner

*Primary Examiner* — Matthew R Buck
(74) *Attorney, Agent, or Firm* — Baker Botts L.L.P.

(57) ABSTRACT

A method and system for coupling a riser to a subsea wellhead are disclosed. A first terminal end of a riser comprised of an inner riser and an outer riser is coupled to the platform and a second terminal end of the riser is coupled to a wellhead. The second terminal end of the inner riser is coupled to an inner drilling riser tie-back connector ("ITBC") having a main body. The ITBC is landed on a landing shoulder disposed within the subsea wellhead. A downward weight is applied to the main body. The application of the downward weight to the main body couples the ITBC and the subsea wellhead.

19 Claims, 7 Drawing Sheets

INNER DRILLING RISER TIE-BACK CONNECTOR FOR SUBSEA WELLHEADS

BACKGROUND

The present disclosure relates generally to well risers and, more particularly, to an improved riser tie-back connector.

In drilling or production of an offshore well, a riser may extend between a vessel or platform at the surface and a subsea wellhead. In certain implementations, the riser may couple the subsea wellhead to a Blow-Out-Preventer ("BOP") located at the surface. The riser may be as long as several thousand feet, and may be made up of successive riser sections that are coupled together through one or more riser connections. Riser sections with adjacent ends may be connected on board the vessel or platform, as the riser is lowered into position. Auxiliary lines, such as choke, kill, and/or boost lines, may extend along the side of the riser to connect with the wellhead, so that fluids may be circulated downwardly into the wellhead for various purposes. A tie-back connector may be used to couple the riser to the subsea wellhead.

It is often desirable to use a riser which has a small inner diameter in order to facilitate fluid flow at higher pressures. For instance, during drilling operations it may be desirable to use a dual riser with an inner riser section that has a small inner diameter in order to provide a higher pressure capacity and improve the hydraulic circulation of the drilling fluid (mud) from the subsea wellhead to the surface. Stated otherwise, using a riser with a smaller diameter allows the fluids to be directed uphole at a higher velocity and with a higher pressure. In certain implementations, the smaller riser may reside inside a larger, lower pressure rated riser. It is therefore desirable to develop a tie-back connector that can couple a small diameter riser to a subsea wellhead.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well risers and, more particularly, to systems and methods for riser coupling.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

The term "platform" as used herein encompasses a vessel or any other suitable component located on or close to the surface of the body of water in which a subsea wellhead is disposed. The terms "couple" or "couples," as used herein are intended to mean either an indirect or a direct connection. Thus, if a first device couples to a second device, that connection may be through a direct connection, or through an indirect (electrical and/or mechanical) connection via other devices and connections. The term "uphole" as used herein means along the drillstring or the hole from the distal end towards the surface, and "downhole" as used herein means along the drillstring or the hole from the surface towards the distal end. It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

Figure 1:
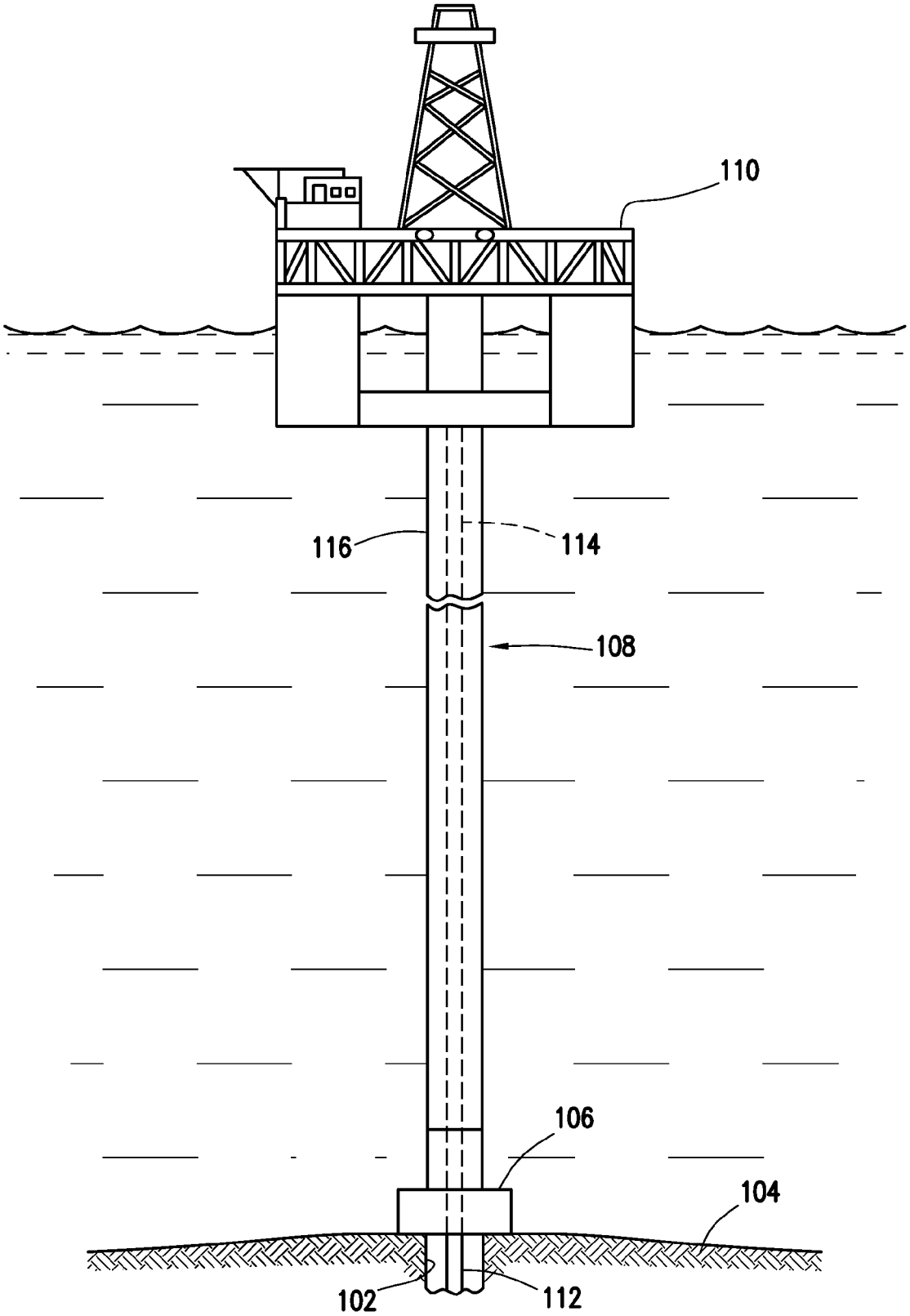
FIG. 1 depicts a system for performance of subsea subterranean formations.

FIG. 1 depicts an illustrative system for performing subsea subterranean operations. In certain illustrative implementations, a wellbore 102 may be drilled into a subterranean formation 104. A wellhead 106 may be placed on the sea floor at an uphole terminal end of the wellbore 102. A riser 108 may then fluidically couple the wellhead 106 to the platform 110 to facilitate fluid flow between the wellhead 106 and the platform 110. Specifically, as shown in FIG. 1, a first terminal end of the riser 108 may be coupled to the platform and a second terminal end of the riser 108 may be coupled to the wellhead 106. A production pipe or a drilling pipe 112 may be inserted into the wellbore 102. Accordingly, fluids may flow between the platform 110 and the subterranean formation 104 through the riser 108, the wellhead 106 and the production pipe or the drilling pipe 112.

It is desirable to provide a fluid flow path between the subterranean formation 104 and the platform 110 that permits efficient fluid flow between the two. In accordance with an illustrative embodiment of the present disclosure which is discussed in further detail below, the riser 108 may include an inner riser pipe 114 which is installed inside an outer riser pipe 116. The term "inner riser pipe" as used herein refers to a riser pipe with an inner diameter that is less than the inner diameter of the outer riser pipe 116. In contrast, the term "outer riser pipe" as used herein refers to a riser pipe with an inner diameter that is greater than the outer diameter of the inner riser pipe 114. In order to facilitate the installation of the inner riser pipe 114 inside the outer riser pipe 116, an Inner Drilling Riser Tie-Back Connector (hereinafter "ITBC") is installed at the wellhead 106. The structure and operation of the ITBC is discussed in further detail in conjunction with FIGS. 2A-C and 3A-C.

Figure 2A:
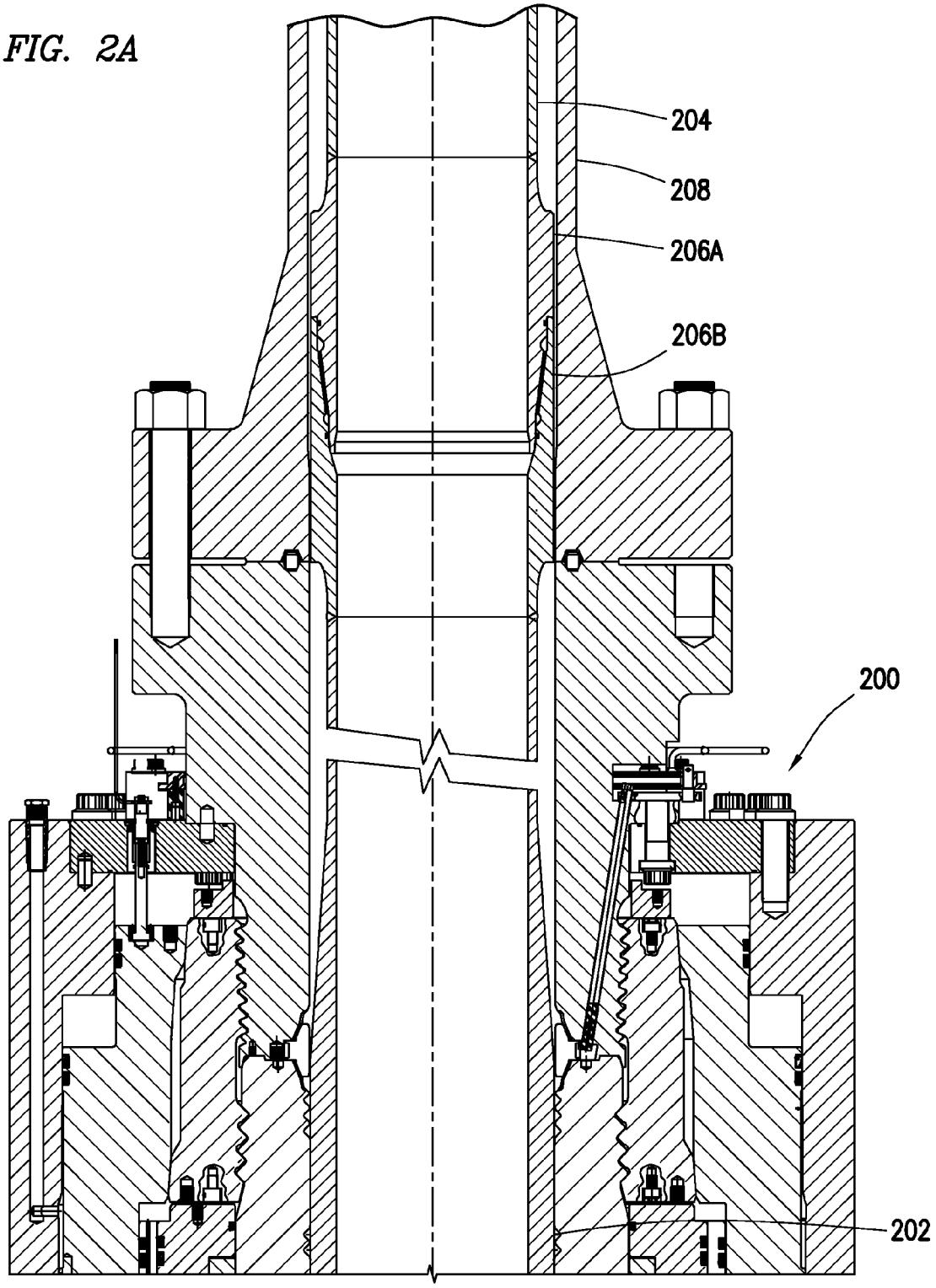
FIGS. 2A and 2B depict an upper portion and a lower portion of a subsea wellhead having an inner drilling riser tie-back connector locked but not fully landed in accordance with an illustrative embodiment of the present disclosure.
Figure 2B:
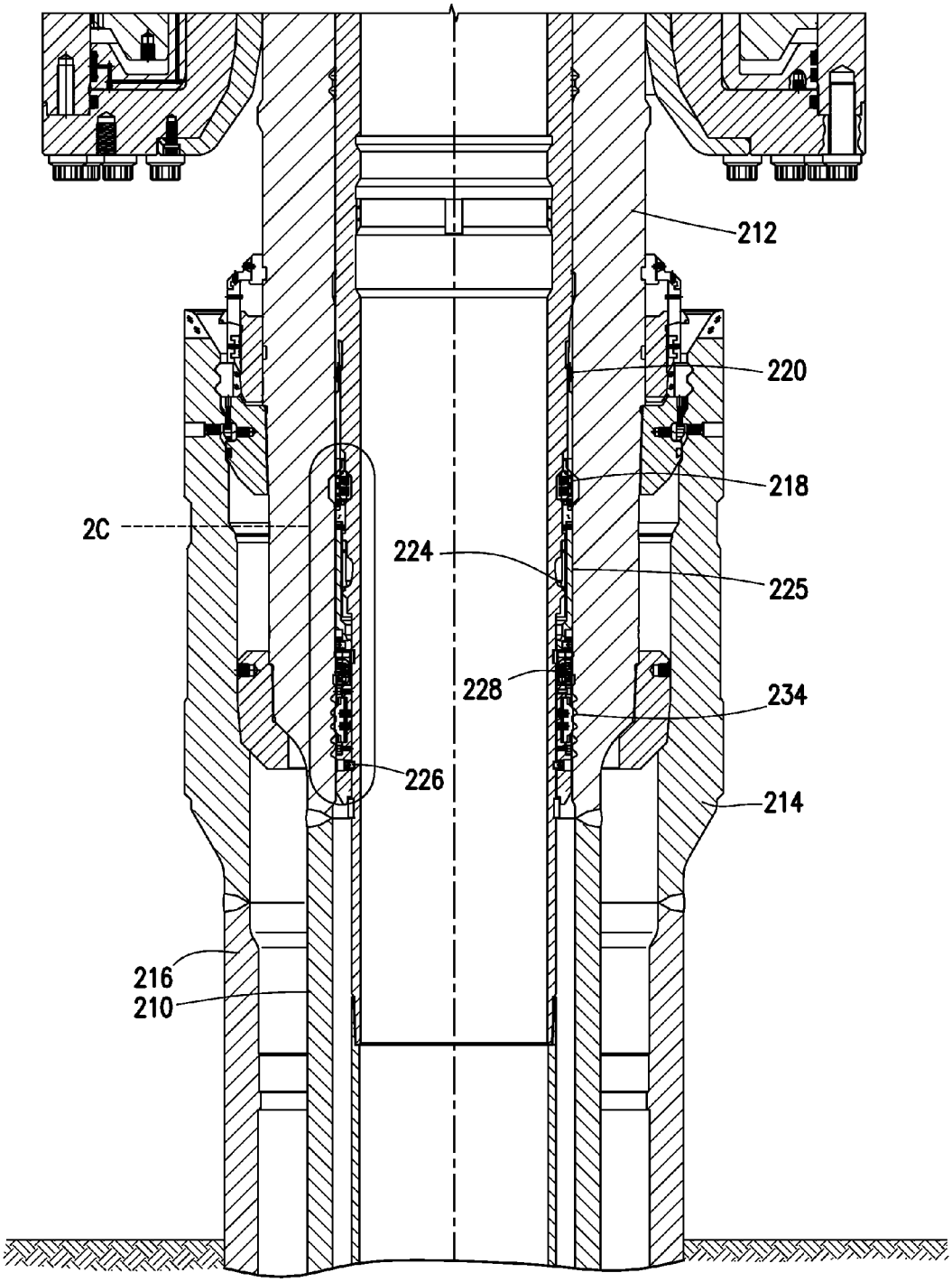
Figure 2C:
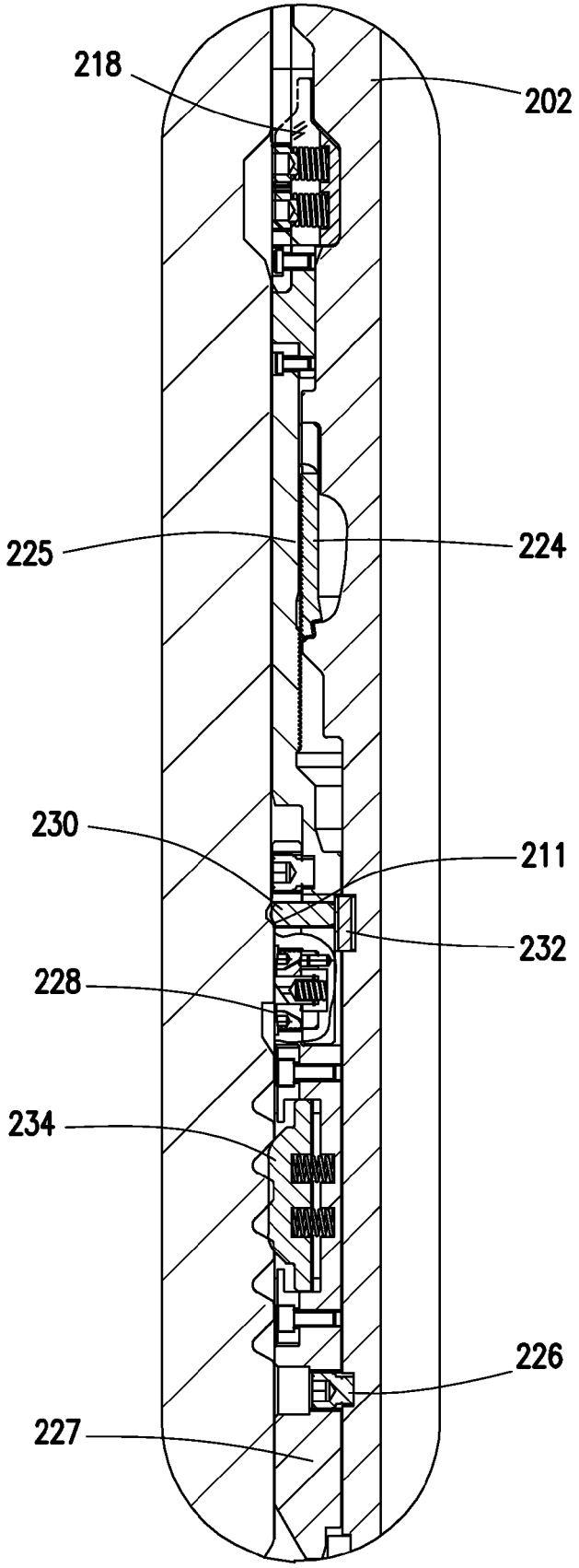
FIG. 2C depicts a close up view of a portion of FIG. 2B.
Figure 3A:
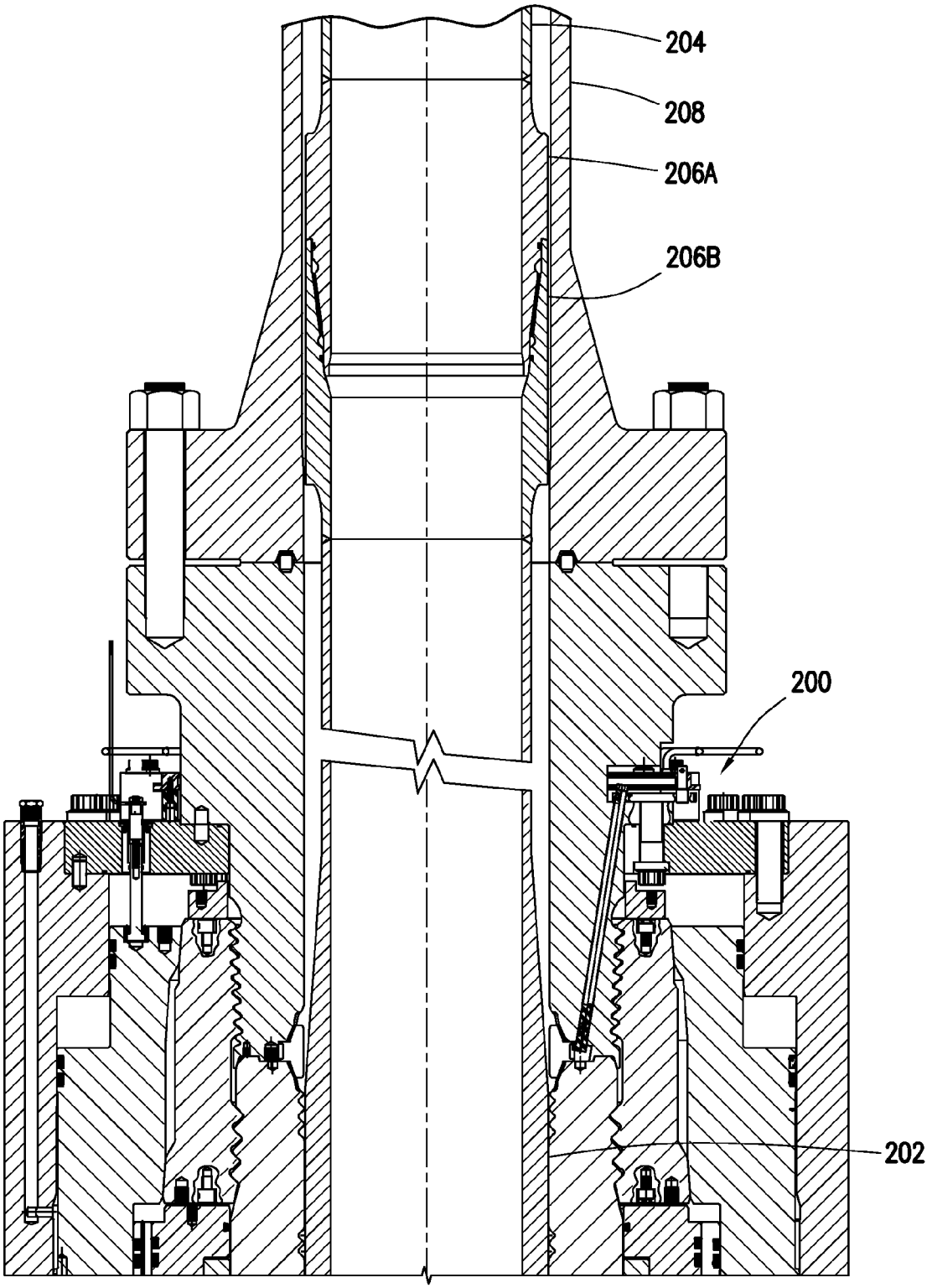
FIGS. 3A and 3B depict an upper portion and a lower portion of a subsea wellhead having an inner drilling riser tie-back connector locked and fully landed in accordance with an illustrative embodiment of the present disclosure.
Figure 3B:
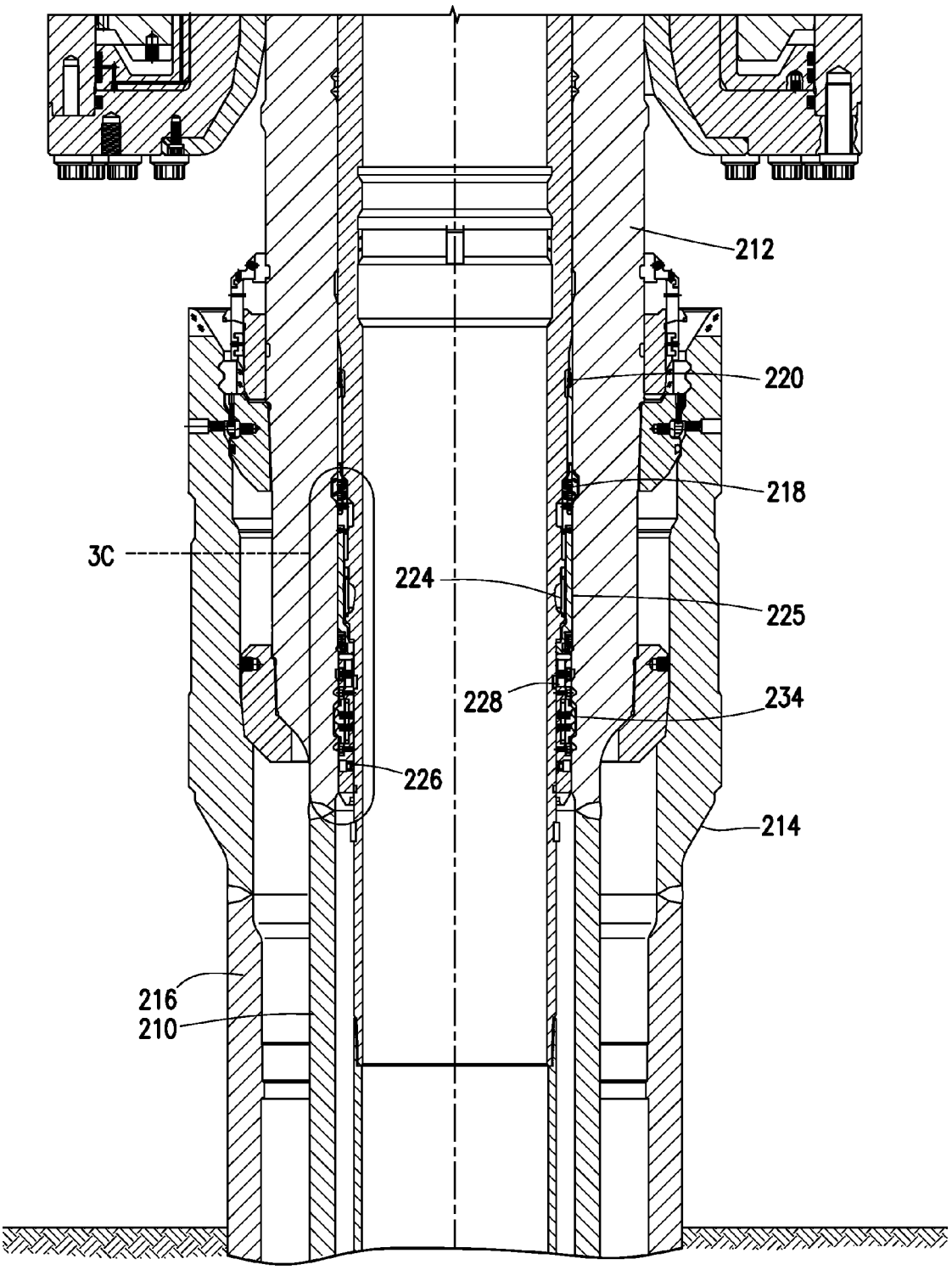
Figure 3C:
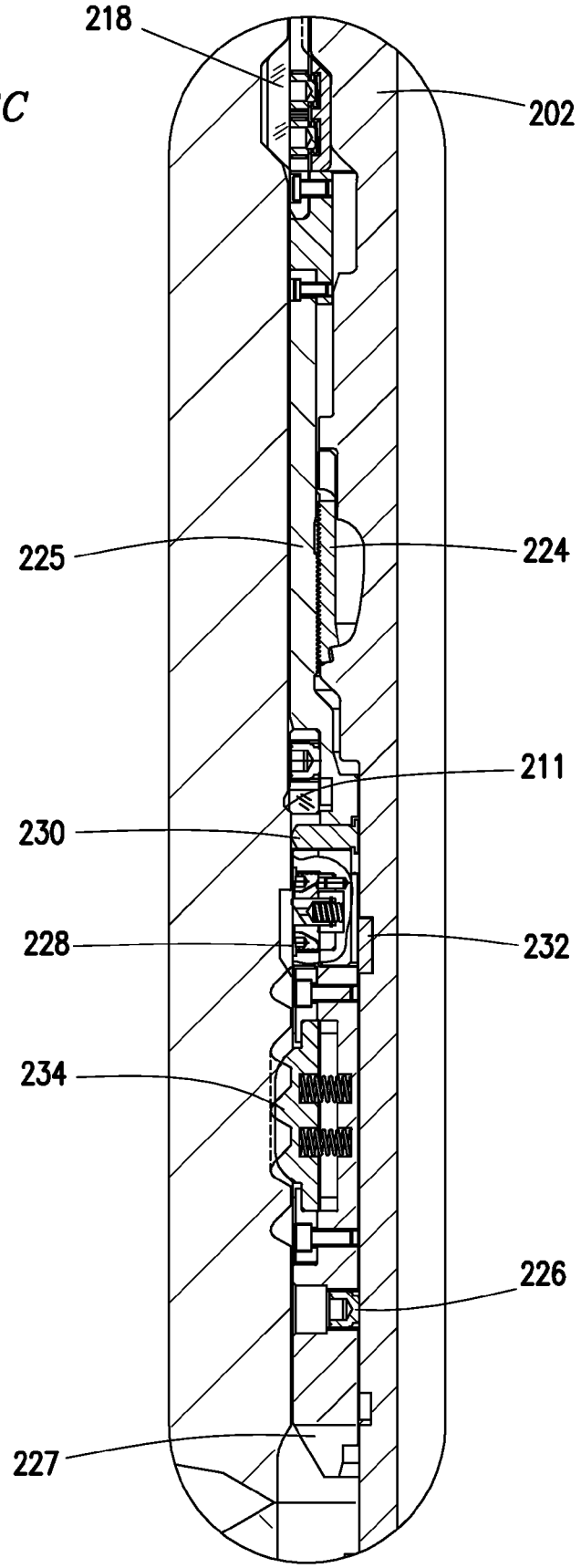
FIG. 3C depicts a close up view of a portion of FIG. 3B.

FIGS. 2A-C and 3A-C depict an ITBC in accordance with an illustrative embodiment of the present disclosure which is denoted generally with reference numeral 200. Specifically, FIGS. 2A-C show the ITBC 200 landed on a small landing shoulder 211 before the seal is activated. In contrast, FIGS. 3A-C show the ITBC 200 fully locked to the subsea wellhead with the metal-to-metal seal activated.

Turning first to FIGS. 2A-C, the ITBC 200 may include a main body 202. The main body 202 may be coupled to an inner riser pipe 204 through one or more riser connections 206A and 206B. In the illustrative embodiment of FIG. 2, there is a threaded engagement between the main body 202, the riser connections 206A, 206B and the inner riser pipe 204. In certain implementations, the ITBC 200 may extend approximately 15-20 feet above a subsea wellhead 212 where it may be coupled to the riser connections 206A and 206B. This extension of the ITBC 200 above the subsea wellhead 212 may reduce the fatigue damage on the ITBC 200.

As shown in FIG. 2, the inner riser pipe 204 may be positioned inside an outer riser pipe 208 which rests at a subsea wellhead 212. As shown in FIG. 2 and discussed in further detail below, the main body 202 couples the inner riser pipe 204 to a production pipe or drill pipe 210 that may be used to direct fluids between the subterranean formation and the subsea wellhead 212. Fluids may then flow from the subsea wellhead 212 to the surface through the inner riser pipe 204. In certain implementations, the subsea wellhead 212 may be disposed within a low pressure housing 214. The downhole end of the low pressure housing 214 may in turn be coupled to a conductor pipe 216.

The main body 202 of the ITBC 200 may be directed downhole through the outer riser pipe 208 and lands and stops on a small shoulder 211 (referred to herein as the "landing shoulder") disposed in the lower bore of the subsea wellhead 212 as shown in FIG. 2B. After the main body 202 lands in the subsea wellhead 212, a downward weight may be applied to the main body 202. The main body 202 of the ITBC 200 may further include a locking ring 218 that is operable to engage a groove in the subsea wellhead 212 when a downward force is applied to the ITBC 200. Specifically, application of this downward weight drives out a locking ring 218 which engages a groove in the subsea wellhead 212. At the same time, the downward weight applied to the main body 202 activates a seal assembly which in certain illustrative embodiments may be a metal-to-metal seal assembly 220 which seals in the middle bore of the subsea wellhead 212. The specific location of the metal-to-metal seal assembly 220 is shown for illustrative purposes only. Specifically, the metal-to-metal seal assembly 220 may be located at any point along the interface between the subsea wellhead 212 and the main body 202 uphole from a lock ring 218.

Any suitable mechanism known to one of ordinary skill in the art may be used to apply this downward force to the main body 202. For instance, in certain illustrative embodiments, the downward force may be applied by the weight of the inner riser pipe 204 above the ITBC 200.

In certain illustrative embodiments, the application of the downward force on the main body 202 retains the pre-load on the metal-to-metal seal assembly 220 using a split ratch latch threaded ring 224. In the illustrative embodiment of FIG. 2, the ratch latch threaded ring 224 is an axial ratchet which is movable downhole along a no-go sleeve 225 that is coupled to or formed integrally with an interior surface of the subsea wellhead 212. Specifically, the ratch latch threaded ring 224 "clicks" as it is pushed downhole along the threads located on a no-go sleeve 225 as the main body 202 of the ITBC 200 travels downhole and eventually snaps into the last thread as the final downward weight is applied to the main body 202. Accordingly, the movement of the ratch latch threaded ring 224 in this manner internally locks the ITBC 200. In certain implementations, the metal-to-metal seal of the metal-to-metal seal assembly 220 may be pre-loaded using a wedge angle (not shown).

In certain embodiments, a set of one or more fixed shear pins 226 are disposed on a landing ring 227. As shown in FIGS. 2 and 3, the landing ring 227 and the shear pins 226 are disposed along an interior surface of the subsea wellhead 212 at an interface of the subsea wellhead 212 and the main body 202 of the ITBC 200. The shear pins 226 are operable to verify accurate riser spacing before locking down the ITBC 200. These shear pins 226 allow an operator to lightly tag out on the landing shoulder 211 in the bore of the subsea wellhead 212 and verify the riser spacing at the surface is correct before committing to the lockdown of the ITBC 200. If riser length adjustments are needed, the inner riser pipe 204 can be raised to the surface and the proper length of inner joint can be installed. The inner riser pipe 204 can then be once again landed in the subsea wellhead 212.

In certain implementations, a series of spring loaded pins 228 may be disposed on the no-go sleeve 225. The spring loaded pins 228 are operable to verify that the main body 202 of the ITBC 200 has reached a desired landing point within the subsea well head 212. Specifically, this series of spring loaded pins 228 may snap into a groove in the subsea wellhead 212 when the main body 202 of the ITBC 200 is fully landed with all the inner riser pipe 204 weight down. Accordingly, an operator may use an overpull during the landing process to verify that the main body 202 has reached its desired landing point within the subsea wellhead 212.

In certain implementations, the ITBC 200 may be reusable. Specifically, the main body 202 may be landed in the subsea wellhead 212 and used to fluidically couple the inner riser pipe 204 to the production or drilling pipe 210. The main body 202 may then be released or disengaged from the subsea wellhead 212 by turning the inner riser pipe 204 which unscrews the ratch latch threading 224. In one embodiment, a clockwise movement of the inner riser pipe 204 may be used to disengage the ratch latch threading 224. The operator may then disengage the ITBC 200 and lift it in order to land the ITBC 200 a second time if necessary.

In accordance with certain embodiments of the present disclosure, the lock ring 218 is designed to withstand both tension loads and compression loads applied by the inner riser pipe 204. Specifically, once the main body 202 is installed in place, the inner riser pipe 204 will be under tension. The lock ring 218 ensures that the inner riser pipe 204 can withstand that tension. Moreover, occurrence of certain events downhole such as, for example, a blow out, can further increase the load on the lock ring 218, both in tension and compression. Therefore, in certain illustrative embodiments, the lock ring 218 may be designed to withstand a force of approximately 2 million lbs. The lock ring 218 may be made from any suitable materials known to those of ordinary skill in the art, including, but not limited to, steel.

Moreover, the locking mechanism of the ITBC 200 has a low Stress Amplification Factor ("SAF") which provides long fatigue life and service life. The low SAF is a result of the structure of the ITBC 200. Specifically, the stress relieving contours in the ratch latch threaded ring 224 and the tight fitting engagement of the main body 202 facilitate the resulting lower SAF.

Accordingly, in operation, the ITBC 200 is directed downhole through the outer riser pipe 208 and is locked in the subsea wellhead 212 as shown in FIGS. 2A-C. A downward weight is then applied to the ITBC 200 which latches the ITBC 200 in place within the subsea wellhead 212 as shown in FIGS. 3A-C. Specifically, as the downward force is applied to the ITBC 200, the ratch latch threaded ring 224 "clicks" as it is pushed downhole along the threads located on the no-go sleeve 225. Once the desired operations are completed, the operator may rotate the inner riser pipe 204 which in turn rotates the ITBC 200, disengaging the ratch latch threaded ring 224. Accordingly, the ITBC 200 is disengaged from the subsea wellhead 212 and may be reused.

In certain implementations, one or more anti-rotation spring loaded keys 234 engage slots in the lower bore of the subsea wellhead 212. These spring loaded keys hold the load mechanism and the seal assembly stationary as the inner riser main body 202 rotates during ITBC 200 release.

In certain illustrative embodiments, the ITBC 200 may further include a detent ring 230 and a detent button 232. In certain implementations, the ITBC 200 may include a plurality of detent buttons 232 that are disposed along a perimeter of the device. The detent button 232 pushes back the detent ring 230 as the ITBC 200 moves downhole. The detent ring 230 and the detent button 232 work together to prevent the premature activation of the ITBC 200. For instance, the detent ring 230/detent button 232 may prevent the activation of the ITBC 200 while the ITBC 200 is passing through the tight fitting rubber elements of the surface BOP stack.

In operation, the ITBC 200 lands on an empty subsea wellhead 212 on a small landing shoulder 211 and couples to the bore of the subsea wellhead 212 with a metal-to-metal seal at the metal-to-metal seal assembly 220 while locking into a groove in the wellhead bore. In accordance with illustrative embodiments of the present disclosure, this coupling of the ITBC 200 to the subsea wellhead 212 bore may be accomplished with the weight down on the inner riser pipe 204 without requiring application of torque to rotate ITBC 200 for installation.

Accordingly, an ITBC 200 in accordance with an illustrative embodiment of the present disclosure allows wellbores to be drilled deeper without having to remove the lower pressure riser. Moreover, a low pressure riser implemented in accordance with embodiments of the present disclosure operates as a second barrier to the environment while the inner riser pipe 204 and the ITBC 200 are installed.

In addition, the methods and systems disclosed herein improve the hydraulic flow of drilling fluids by circulating fluids through a smaller inner riser pipe. Further, the disclosed methods and systems add structural strength to the drilling riser system as the strength of the low pressure outer riser pipe and the high pressure inner riser pipe are cumulative.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A system for coupling a platform to a subsea wellhead comprising:

a riser extending between the platform and the subsea wellhead, wherein the riser comprises an inner riser and an outer riser;

an inner drilling riser tie-back connector ("ITBC") having a main body, wherein the ITBC is coupled to the inner riser, wherein the ITBC further comprises a locking ring operable to engage a groove in an internal bore of the subsea wellhead;

a seal assembly disposed at an interface directly between the internal bore of the subsea wellhead and an external wall of the main body, wherein the seal assembly is disposed uphole relative to the locking ring; and a ratch latch threaded ring disposed within the ITBC, wherein the ratch latch threaded ring is movable downhole along a no-go sleeve disposed against the internal bore of the subsea wellhead.

2. The system of claim 1, further comprising a low pressure housing, wherein the subsea wellhead is disposed within the low pressure housing.

3. The system of claim 1, further comprising one or more shear pins disposed at an interface of the main body and the subsea wellhead.

4. The system of claim 3, wherein the one or more shear pins are operable to verify accurate riser spacing.

5. The system of claim 1, wherein the ITBC further comprises one or more spring loaded pins and wherein the one or more spring loaded pins are operable to verify that the ITBC has reached a desired landing point within the subsea wellhead.

6. The system of claim 1, wherein the seal assembly is a metal-to-metal seal assembly.

7. The system of claim 1, wherein the ratch-latch threaded ring is connected to the main body such that the ratch-latch threaded ring covers a concave groove formed in the main body, wherein the ratch-latch threaded ring comprises stress relieving contours adjacent the concave groove to reduce a stress amplification factor of the ITBC.

8. A method of coupling a subsea wellhead to a platform comprising:

coupling a first terminal end of a riser to the platform and a second terminal end of the riser to the subsea wellhead, the riser comprising an inner riser and an outer riser;

coupling the second terminal end of the inner riser to an inner drilling riser tie-back connector ("ITBC") having a main body;

landing the main body on a landing shoulder disposed within the subsea wellhead;

applying a downward weight to the main body to lock and seal the ITBC against an internal bore of the subsea wellhead at approximately the same time without rotating the ITBC wherein locking and sealing the ITBC against the internal bore of the subsea wellhead by application of a downward weight comprises:

engaging a groove in the internal bore of the subsea wellhead by a locking ring disposed on the main body;

activating a seal assembly disposed at an interface directly between the internal bore of the subsea wellhead and an external wall of the main body; and directing a ratch latch threaded ring downhole along threads disposed on an interior surface of a no-go sleeve disposed against the internal bore of the subsea wellhead, wherein the movement of the ratch latch thread ring internally locks the ITBC without rotation of the ITBC.

9. The method of claim 8, further comprising disposing the seal assembly uphole relative to the locking ring.

10. The method of claim 8, wherein the seal assembly comprises a metal-to-metal seal assembly.

11. The method of claim 8, further comprising disengaging the main body from the subsea wellhead, wherein disengaging the main body from the subsea well head comprises rotating the inner riser.

12. The method of claim 11, wherein rotating the inner riser disengages the ratch latch threaded ring.

13. The method of claim 8, wherein applying a downward weight to the main body comprises applying the weight of the inner riser to the main body.

14. The method of claim 8, further comprising disposing one or more shear pins at an interface of the main body and the subsea wellhead and verifying accurate riser spacing using the one or more shear pins.

15. The method of claim 8, further comprising using one or more spring loaded pins to verify that the ITBC has reached a desired landing point within the subsea wellhead.

16. The method of claim 15, wherein using the one or more spring loaded pins to verify that the ITBC has reached a desired landing point comprises:

snapping the one or more spring loaded pins into a corresponding groove in the subsea wellhead when the ITBC has landed; and overpulling the inner riser to apply an upward force to the one or more spring loaded pins and ensure that the one or more spring loaded pins are disposed in the corresponding groove.

17. A method of coupling a riser having an inner riser and an outer riser to a subsea wellhead comprising:

coupling the inner riser to an inner drilling riser tie-back connector ("ITBC") having a main body;

directing the ITBC into the subsea wellhead;

landing the main body on a landing shoulder;

applying a downward weight to the main body, wherein the application of the downward weight engages a groove in an internal bore of the subsea wellhead by a locking ring disposed on the main body, wherein the application of the downward weight activates a seal assembly disposed uphole relative to the locking ring at an interface between the internal bore of the subsea wellhead and an external wall of the main body, and wherein the application of the downward weight directs a ratch latch threaded ring downhole along threads disposed on an interior surface of a no-go sleeve disposed against the internal bore of the subsea wellhead, wherein the movement of the ratch latch thread ring internally locks the ITBC.

18. The method of claim 17, further comprising disengaging the main body from the subsea wellhead, wherein disengaging the main body from the subsea well head comprises rotating the inner riser and disengaging the ratch latch threaded ring.

19. The method of claim 17, further comprising disposing one or more shear pins at an interface of the main body and the subsea wellhead and verifying accurate riser spacing using the one or more shear pins.

* * * * *